United States Patent [19]

Vache

[11] 4,181,453

[45] Jan. 1, 1980

[54] APPARATUS FOR POSITIONING AN OFF-SHORE WEIGHT STRUCTURE ON A PREVIOUSLY POSITIONED SEA BED UNIT

[75] Inventor: Jean-Claude Vache, Roissy en Brie, France

[73] Assignee: Sea Tank Co., Rungis, France

[21] Appl. No.: 934,282

[22] Filed: Aug. 16, 1978

[30] Foreign Application Priority Data

Aug. 24, 1977 [GB] United Kingdom ..... 35576/77
Dec. 23, 1977 [FR] France ..... 77 39124

[51] Int. Cl.[2] ..... E02B 17/00; B63B 35/44

[52] U.S. Cl. ..... 405/203; 405/205; 405/195

[58] Field of Search ..... 405/204, 205, 206, 207, 405/203, 208, 209, 195; 175/7

[56] References Cited

U.S. PATENT DOCUMENTS

| | | | |
|---|---|---|---|
| 3,433,024 | 3/1969 | Diamond et al. | 405/205 X |
| 3,485,056 | 12/1969 | Helmus | 405/189 |
| 3,527,294 | 9/1970 | Weiss et al. | 175/7 X |
| 3,528,254 | 9/1970 | Graham | 405/204 |
| 3,611,734 | 10/1971 | Mott | 405/206 |
| 3,618,327 | 11/1971 | Frein et al. | 405/205 |
| 3,982,401 | 9/1976 | Loggins | 175/7 X |

FOREIGN PATENT DOCUMENTS

| | | |
|---|---|---|
| 2303054 | 7/1974 | Fed. Rep. of Germany . |
| 96425 | 5/1972 | France . |
| 2106684 | 5/1972 | France . |
| 2145854 | 2/1973 | France . |
| 2209376 | 6/1974 | France . |

*Primary Examiner*—Dennis L. Taylor

*Attorney, Agent, or Firm*—Sughrue, Rothwell, Mion, Zinn and Macpeak

[57] ABSTRACT

Apparatus for positioning an off-shore weight structure on a previously positioned sea bed unit during lowering of the weight structure onto the sea bed. The sea bed unit comprises a unit template surrounded by a guide structure in the form of a perimeter frame. The weight structure comprises a base caisson of reinforced concrete and at least one hollow reinforced concrete tower projecting upwardly therefrom for supporting a work deck out of the water.

Co-operating contacts are provided on the sea bed unit and in a sea bed unit receiving recess in the lower surface of the base caisson, and a plurality of anchors for location on the sea bed around the sea bed unit and for fixing to the sea bed independently of the sea bed unit, and co-operating winches are connected to the anchors by cables. During lowering progressively more accurate guide systems are used. The winches enable the recess to come into contact with the guide structure surrounding the template. Camming action between the guide structure and the rim of the recess brings the weight structure very near the required alignment, and finally camming between elements on the template and co-operating elements in the recess completes the procedure, without at any time having to apply undue stress to the sea bed unit. Guidelines lead from the sea bed unit to tension-limiting winches on the work plateform for guide purposes, but the limiting tensions are set so that little force is transmitted from the structure to the sea bed unit via the guidelines.

10 Claims, 5 Drawing Figures

APPARATUS FOR POSITIONING AN OFF-SHORE WEIGHT STRUCTURE ON A PREVIOUSLY POSITIONED SEA BED UNIT

FIELD OF THE INVENTION

The present invention relates to the positioning of an off-shore weight structure over a previously positioned sea bed unit. The type of sea bed unit most particularly concerned includes a drilling template and the positioning of the weight structure on the template should be sufficiently accurate for easy connection of pipework between well-heads on the sea bed unit and storage tanks or pipelines connected to the weight structure.

BACKGROUND OF THE INVENTION

The exploitation of undersea oil fields from a drilling platform or production platform currently required that a finished platform should be positioned on site before the production wells are drilled. However, the capital expenditure required is very large and it is desireable to provide the quickest possible return on it. This could be achieved by drilling at least some of the production wells while a production platform is under constuction. The difficulty lies in positioning the weight structure on the existing well-heads without damaging them.

Weight structures are generally lowered on site by progressive ballasting while they are held in position by tugs; the position being determined by various guide systems which enable increasingly accurate positioning of the structure as it is lowered. However, presently used methods do not enable the structure to be positioned sufficiently accurately for connection to pre-existing well-heads, which requires an accuracy of a few centimeters. Further, when the enormous mass of a weight structure is taken into consideration, it will be realised that even very sight horizontal movement is liable to badly damage the apparatus on the sea bed unit. The most accurate presently used systems include winch means connected between the structure and the sea bed unit. These means are used to pull the weight structure into position with respect to the sea bed unit, but have the drawback of applying equally large forces to the sea bed unit itself. In particular, the sea bed unit suffers from large mechanical shocks due to the dynamic behaviour of the weight structure.

Preferred embodiments of the present invention enable a weight structure to be accurately positioned on the preexisting sea bed unit while applying minimal forces thereto.

SUMMARY OF THE INVENTION

The present invention provides apparatus for positioning an off-shore weight structure on a previously positioned sea bed unit during lowering of the weight structure onto the sea bed, the weight structure comprising a base caisson of reinforced concrete and at least one hollow reinforced concrete tower projecting upwardly therefrom for suporting a work deck out of the water. The apparatus comprises:

co-operating contact means provided on the sea bed unit and in a sea bed unit receiving recess in the lower surface of the base caisson, said means being provided for mutual guiding engagement during the final stages of lowering;

a plurality of anchors for location on the sea bed around the sea bed unit and for fixing to the sea bed independently of the sea bed unit; and winch means connecting the weight structure to the anchors in an arrangement such, that during lowering, the winch means is usable to guide the weight structure to cause the co-operating contact means of the sea bed unit and of the base caisson to engage and guide the weight structure during the final stages of lowering.

The present invention preferably includes at least one of the following features.

The co-operating contact means comprise shock absorbing devices internally lining at least a part of the rim of the said recess and a co-operating guide structure forming a part of the sea bed unit; preferably the shock absorbing devices comprise a plurality of devices which are independently deformable under the effect of internal pressure to enable accurate tensioning of the weight structure with respect to the sea bed unit, for example these devices may be inflatable cylindrical fenders disposed so that they lie in substantially the same horizontal plane.

The sea bed unit may comprise a drilling template which is surrounded by a guide structure in the form of a rectangular frame of steel tubing which has fenders at its corners for engaging the shock absorbing devices in the recess. Advantageously the guide structure is temporarily secured to the template so that during installation of the sea bed unit on the sea bed the guide structure is accurately and correctly positioned relative to the template and therefore in due course the weight structure will also be correctly positioned relative to the template, but that during said positioning of the weight structure direct contact between the guide structure and the template is completely removed so that any shock received by the guide structure will not be transmitted to the template.

The co-operating contact means may further comprise guide posts (preferably on the template only) and mating sockets projecting downwardly from the upper surfaces of the recess in the weight structure. The mating sockets may constitute the ends of vertical pipes which serve to guide guidelines up the tower from the guide posts to tension-limiting winches on the work deck, the said guidelines being used in conjuction with devices such as in inclinometers for checking the relative distance of the weight structure and the sea bed unit.

Other measuring devices may also be used, e.g. acoustic systems or television systems mounted on the platform and trained on reference markers mounted on the sea bed unit thereby providing an increasingly accurate check on the position of the platform as it is lowered.

An embodiment of the invention is described by way of example with reference to the accompanying drawings.

DESCRIPTION OF THE PREFERRED EMBODIMENT

Figure 1:
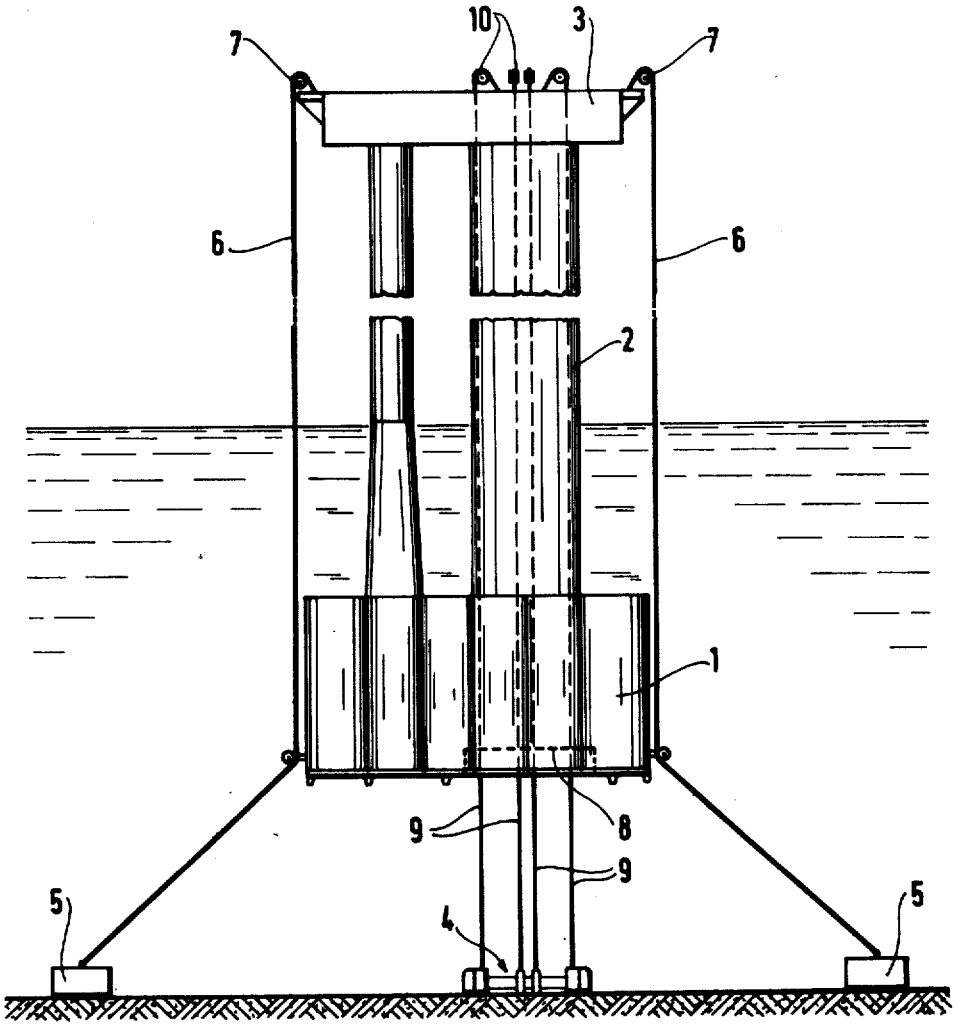
FIG. 1 is an elevational view showing the use of a first type of guide system in accordance with the invention.

In FIG. 1 an off-shore weight structure or platform comprises a multicellular base caisson 1 of pre-stressed concrete with at least one hollow concrete tower 2 (two in this case) supporting a work deck 3 out of the water. The platform is to be positioned and centred over a unit 4 which has been previously anchored to the sea bed.

The sea bed unit 4 (see FIGS. 2 to 5) comprises a template 13 secured to the sea bed by piles and surrounded by a guide structure 15, 17, itself anchored by piles. A set of oil wells has already been drilled by a semi-submersible drilling rig (not shown) and the platform is to be installed over the sea bed unit 4 for oil production.

Initially the platform is towed to the neighbourhood of its installation site in a conventional manner. The platform is provided with a plurality of independent anchors 5 to which it is connected by respective cables 6 controlled by independent winches 7. On site, the anchors are positioned around the sea bed unit 4 at a sufficient distance to avoid any danger of collision therewith. The cables 6 are then progressively tightened and the connections between the platform and its tugs are released, giving rise to the situation shown in FIG. 1.

A plurality of guide systems are provided for increasingly accurate positioning of the platform as it is lowered until it comes to rest on the sea bed.

It is essential for the apparatus of the invention to provide very accurate positioning of the platform in order to enable the structure to establish connections with the sea bed unit 4. The position of the platform is controlled with progressively increasing accuracy as it is lowered and its downward speed is progressively reduced.

A first guide system is constituted by winch means, namely the winches 7 with their respective cables 6 which are connected to independent anchors 5. The winch means are used to lower the platform with proper alignment over the sea bed unit 4 until contact is established therewith. Naturally the winching operations are combined with conventional ballasting operations to provide controlled lowering of the platform. It should be noted that this first guide system avoids applying any dynamic forces to the sea bed unit, which constitutes a marked improvement over prior techniques in that no force-transmitting connection is established between the platform and the sea bed unit until the platform is nearly at the end of its downward travel, thereby avoiding any contact until movement of the platform is under firm control.

Once the platform comes into contact with the sea bed unit, a second guide system comes into operation. This second system is more accurate than the first system and comprises co-operating contact means which are described below.

Guidelines 9 may be provided, extending from tension-limiting winches 10 mounted on the work deck, through the hollow column 2 to the sea bed unit 4. These lines should be kept taut by progressively winding them in on the winches 10 as the platform is lowered, but the limit tension of the winches 10 should be set low enough for there to be no substantial pull exerted on the sea bed unit 4. All the downward force that needs to be exerted on the platform should come from the cables 6 and their anchors 5.

The speed at which the platform is lowered is progressively reduced to a maximum permitted contact speed. Once contact is established the sea bed unit is progressively received in a recess 8 formed in the lower surface of the base caisson 1 and so dimensioned that, when the platform is standing on the sea bed over the sea bed unit 4, it does not bear directly thereon, thereby ensuring that little stress is applied to the sea bed unit by the platform either during the lowing operation or once the platform is in position.

Figure 2:
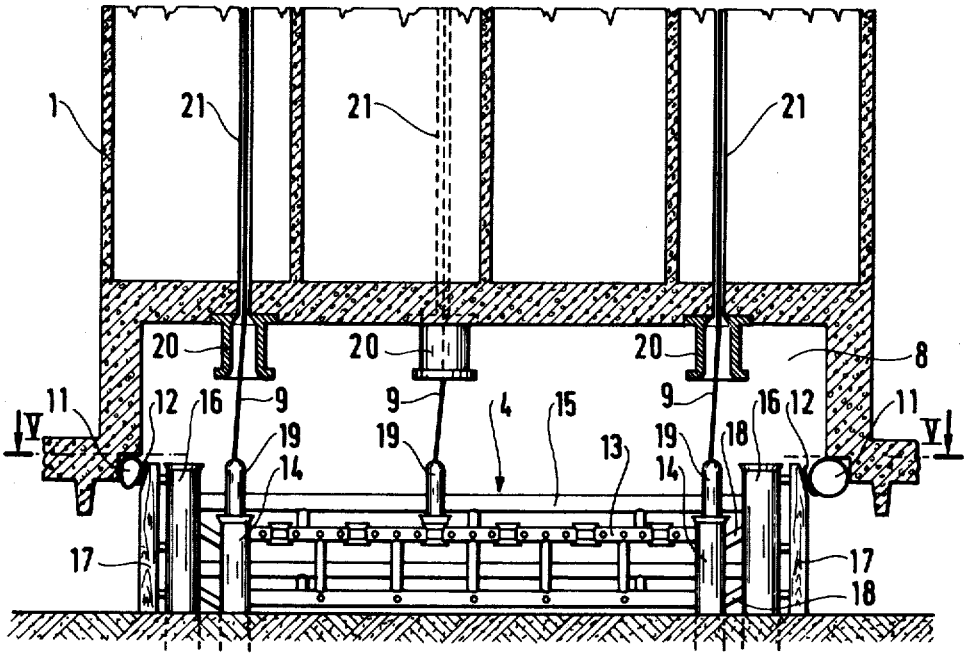
FIGS. 2 to 4 are vertical cross-sectional views showing the use of a second type of guide system, complementary to the first, at successive steps during lowering.

FIG. 2 shows the position just as the platform comes into contact with the sea bed unit. The said co-operating contact means comprises shock-absorbing devices fixed to the platform and internally lining at least a part of the rim of the recess and acting in conjunction with the guide structure that surrounds the sea bed unit.

Figure 5:
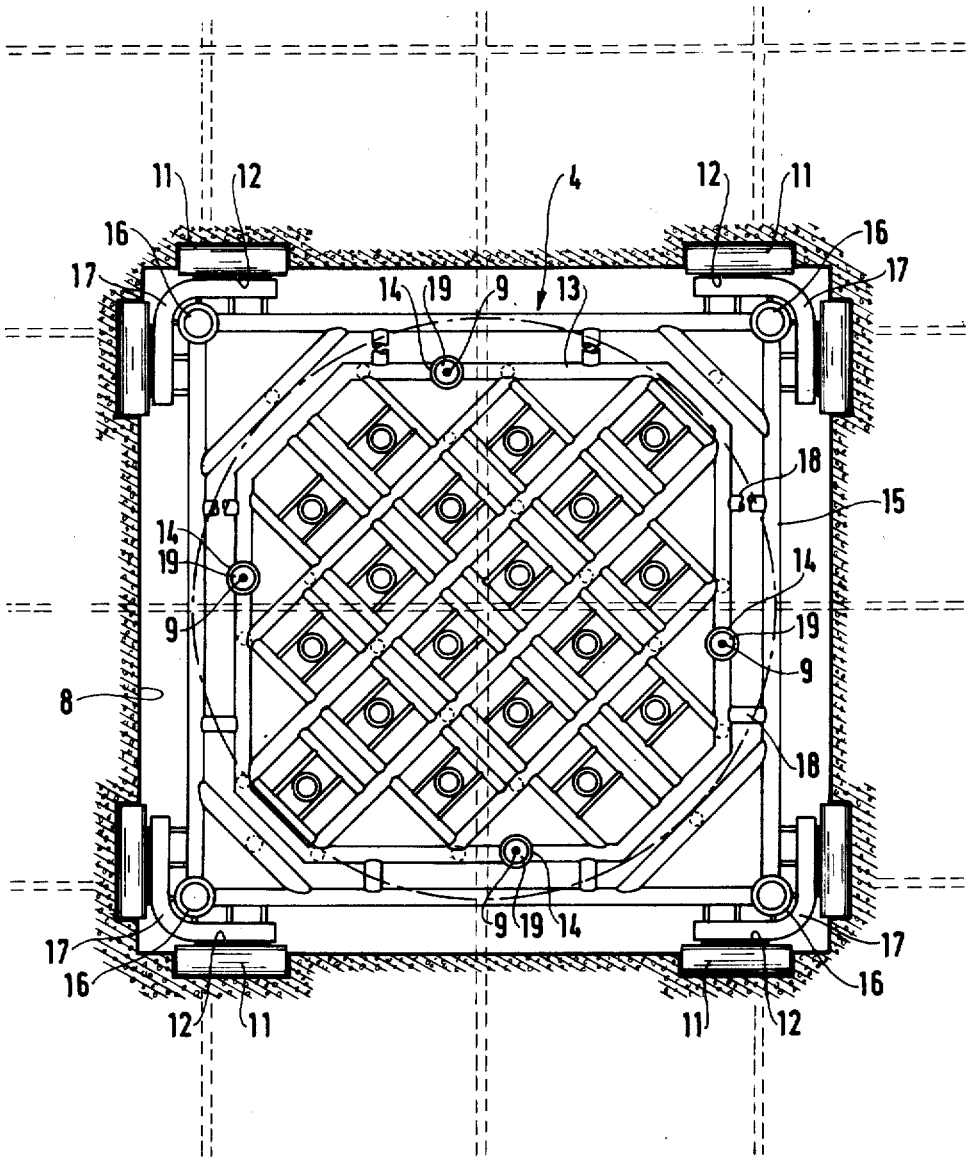
FIG. 5 is a transverse section in plane V—V of FIG. 2.

The shock-absorbing devices are independent cylindrical fenders 11 disposed around the rim of the recess so that they lie in substantially the same horizontal plane (see also FIG. 5). The fenders are preferably inflatable for accurate centering of the platform over the sea bed unit. It should be noted that other types of device which are deformable under the effect of internal pressure could have been used for this purpose—e.g. certain types of jack. The fenders 11 are provided with protective plates 12 to avoid possible tearing on contact with shoes 17 of the guide structure 15 of the sea bed unit. In FIG. 2 the platform is deliberately shown in an off-centre position to illustrate the means used for achieving the desired centering. The fender 11 on the left hand side of the figure is more highly compressed than that on the right hand side and there is therefore a net pneumatic thrust exerted on the platform towards the left to bring it to a central position. This automatic effect may be increased by use of means for controlling the degree of inflation of the fenders 11.

The template 13 and the guide structure 15, 17 are both provided with respective guide tubes 14 and 16 for directing the piles by which they are anchored to the sea bed. The guide structure comprises a rectangular frame 15 of steel tubing with one of its pile guiding tubes 16 at each corner. On the outside of each corner it has fenders in the form of wooden shoes 17 which engage the inflatable shock-absorbing fenders 11. The upper edges of the shoes 17 are inclined to provide a degree of camming against the fenders 11 therby enlarging the tolerance to which the winch means must position the platform before contact is established with the sea bed unit.

The template 13 and the guide structure are both constructed from frames of steel tubing which are interconnected by tubular connection members 18 so that a single integral unit is provided for anchoring to the sea bed. However, when the platform comes into contact with the guide structure there is a danger that large forces will be applied to the template by virtue of the direct connection between the guide structure and the template. To avoid this the connection members 18 should be destructible to remove all direct contact between the guide structure and the template, each remaining in position by virtue of its own set of piles. This has been shown schematically in FIG. 5 for some of the connection members 18. The destruction may be performed manually by a diver or from a submersible or automatically e.g. by explosives.

Figure 3:
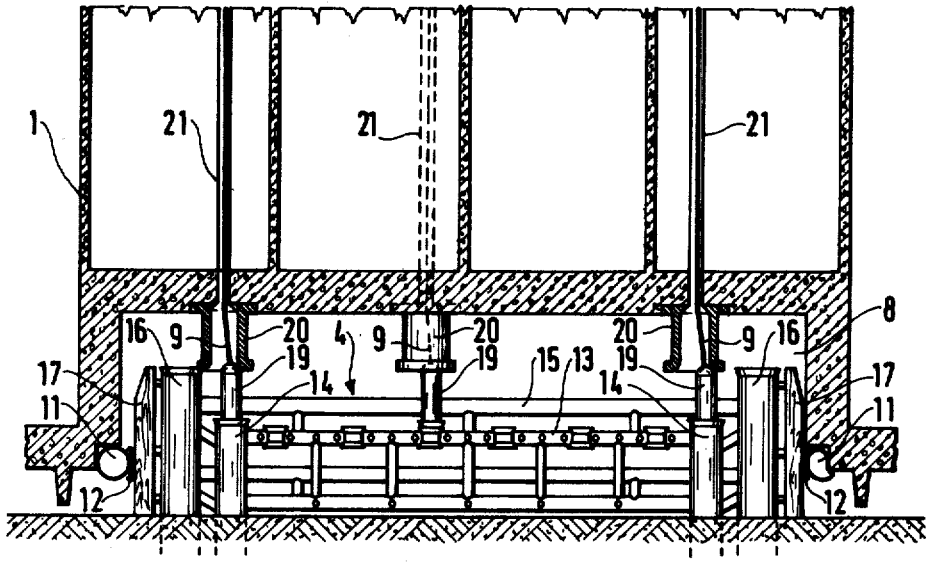
Figure 4:
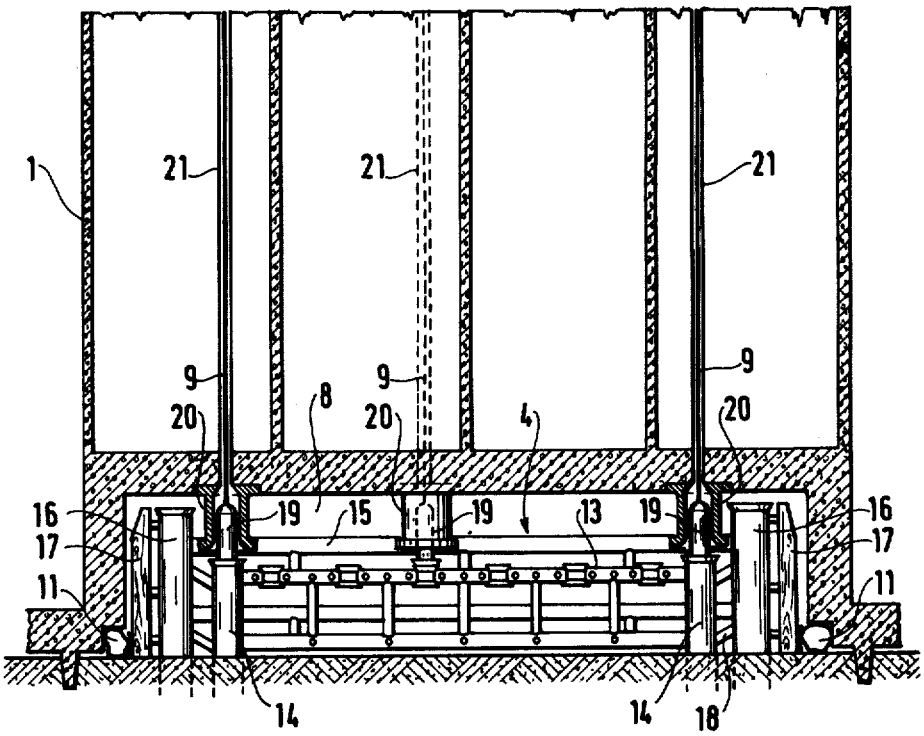

The co-operating contact means include further means for even more accurate centering in the last stages of lowering. These further means comprise guide posts 19 mounted on the template and having upper domed ends which are received into slightly flared mating socket 20 projecting downwardly from the upper surface of the recess 8 in the base caisson 1. There are four of these guide posts 19 and they prolong upwardly the axis of the guide tubes 14 through which the piles of the template are driven. FIG. 3 shows the initial contact between the guide posts 19 and the sockets 20. Once the guide posts 19 are safely received inside the sockets the pressure in the inflatable fenders 11 is advantageously released in order to reduce friction. The ballasting of the base caisson is then completed and the platform arrives at its final centred position as shown in FIG. 4 where it can be seen to be standing on the sea bed.

The sockets 20 constituted the ends of vertical pipes 21 which serve to guide the guide-lines 9 up the tower 2, since the guide-lines 9 are connected to the guide posts 19. The guide-lines 9 are used in conjunction with devices such as inclinometers to provide a continuous check on the relative disposition of the platform and the sea bed unit throughout the lowering operation.

In a more general manner measuring devices such as acoustic systems or television systems trained on reference markers mounted on the sea bed unit will be used to provide increasingly accurate checks on the position of the platform as it is lowered. These checks should determine the exact relative positions of the platform and the sea bed unit for calculation of the horizontal displacements required to bring the platform over the sea bed unit with sufficient accuracy for the co-operating contact means to function.

I claim:

1. Apparatus for positioning an off-shore weight structure on a previously positioned sea bed unit during lowering of the weight structure onto the sea bed, the weight structure comprising a base caisson of reinforced concrete and at least one hollow reinforced concrete tower projecting upwardly therefrom for supporting a work deck out of the water; the apparatus comprising:

co-operating contact means provided on the sea bed unit and in a sea bed unit receiving recess in the lower surface of the base caisson, respectively, said means being provided for mutual guiding engagement during the final stages of lowering of the weight structure;

a plurality of anchors for locating on the sea bed around the sea bed unit and for fixing the weight structure to the sea bed independently of the sea bed unit; and winch means connecting the weight structure to the anchors in an arrangement such that during lowering, the winch means are usable to guide the weight structure to cause the co-operating contact means of the sea bed unit and of the base caisson to engage and guide the weight structure during the final stages of lowering of the weight structure.

2. Apparatus according to claim 1, wherein said recess bears a rim and said sea bed unit comprises a guide structure, the co-operating contact means comprise shock-absorbing devices internally lining at least a part of the rim of said recess and the co-oeprating guide structure of the sea bed unit.

3. Apparatus according to claim 2, wherein the shock-absorbing devices comprise a plurality of devices which are independently deformable under the effect of internal pressure to enable accurate centering of the weight structure with respect to the sea bed unit.

4. Apparatus according to claim 3, wherein the shock-absorbing devices are inflatable cylindrical fenders disposed so that they lie in substantially the same horizontal plane.

5. Apparatus according to claim 2, wherein the sea bed unit comprises a drilling template surrounded by a guide structure in the form of a rectangular frame of steel tubing having fenders at its corners for engaging the shock absorbing devices.

6. Apparatus according to claim 5, wherein the surrounding rectangular frame of steel tubing is connected to the template by destructible links to avoid thrust due to the engagement of the fenders and the shock-absorbing devices from being transmitted directly to the template.

7. Apparatus according to claim 2, wherein the co-operating contact means further comprise guide posts on the sea bed unit and mating sockets projecting downwardly from the upper surface of the sea bed unit receiving recess.

8. Apparatus according to claim 7, wherein the guide posts are provided only on the template proper.

9. Apparatus according to claim 8, wherein the work deck comprises tension-limiting winches, the mating sockets constitute the ends of vertical pipes which serve to guide guidelines up the tower from the guide posts to said tension-limiting winches on said work deck, and said guidelines being used in conjunction with inclinometers for checking the relative dispositions of the weight structure and the sea bed unit.

10. Apparatus according to claim 1, comprising measuring devices mounted on the platform and trained on reference markers mounted on the sea bed unit to provide increasingly accurate checks on the position of the platform as it is lowered.

* * * * *